US006168687B1

(12) United States Patent
Hu et al.

(10) Patent No.: US 6,168,687 B1
(45) Date of Patent: Jan. 2, 2001

(54) SYSTEM AND METHOD FOR SHEET MEASUREMENT AND CONTROL IN PAPERMAKING MACHINE

(75) Inventors: Hung-Tzaw Hu, Saratoga; Lee Chase, Los Gatos; John Goss, San Jose; John Preston, Los Altos, all of CA (US)

(73) Assignee: Honeywell-Measurex Corporation, Cupertino, CA (US)

( * ) Notice: Under 35 U.S.C. 154(b), the term of this patent shall be extended for 0 days.

(21) Appl. No.: 09/066,802

(22) Filed: Apr. 24, 1998

(51) Int. Cl.[7] ..... D21F 11/00

(52) U.S. Cl. ..... 162/198; 162/252; 162/253; 162/259

(58) Field of Search ..... 162/198, 252, 162/253, 262, 263, 258, DIG. 6, DIG. 10, DIG. 11

(56) References Cited

U.S. PATENT DOCUMENTS

| | | | | |
|---|---|---|---|---|
| 2,922,475 | * | 1/1960 | Alexander | 162/252 |
| 3,206,642 | | 9/1965 | Canter et al. . | |
| 3,593,128 | | 7/1971 | Perry . | |
| 3,630,836 | | 12/1971 | Bietry et al. . | |
| 3,636,327 | | 1/1972 | Troutman . | |
| 3,646,434 | | 2/1972 | Norwich . | |
| 3,654,075 | | 4/1972 | Keyes et al. . | |
| 3,666,621 | * | 5/1972 | Adams | 162/258 |
| 3,713,966 | * | 1/1973 | Lippke | 162/263 |
| 3,723,712 | | 3/1973 | Komline, Sr. et al. . | |
| 3,723,865 | | 3/1973 | Batey et al. . | |
| 3,795,984 | | 3/1974 | Meyer . | |
| 3,811,087 | | 5/1974 | Schmelzer . | |
| 3,864,626 | | 2/1975 | MacLean et al. . | |
| 3,909,380 | | 9/1975 | Day et al. . | |
| 3,986,110 | | 10/1976 | Overall et al. . | |
| 4,135,151 | | 1/1979 | Rogers et al. . | |
| 4,259,632 | | 3/1981 | Ahtiainen . | |
| 4,314,878 | | 2/1982 | Lee . | |

(List continued on next page.)

FOREIGN PATENT DOCUMENTS 0276106 7/1988 (EP) .

*Primary Examiner*—Stanley S. Silverman
*Assistant Examiner*—Robert McBride
(74) *Attorney, Agent, or Firm*—Burns, Doane, Swecker & Mathis, L.L.P.

(57) ABSTRACT

Significant improvements in papermaking control can be achieved by employing an array of sensors that are positioned underneath the wire of the machine to measure the conductivity of the aqueous wet stock. The conductivity of the wet stock is directly proportional to the total water weight within the wet stock; consequently, the sensor provides information which can be used to monitor and control the quality of the paper sheet produced. Because CD water weight profile is obtained practically instantaneously, the MD and CD variations are essentially decoupled. Quality improvements to the sheet fabricated will be achieved by providing fast control of the actuators on the machine and by tuning components on the machine to eliminate the sources of variations. Further, the dry stock weight of a sheet of wet stock that is resting on a water permeable moving wire of the papermaking machine can be made employing a water weight sensor element that is positioned adjacent to the wire and that generates signals indicative of the water weight of the sheet of wet stock on the wire. Moreover, the moisture level cross-direction (CD) profile of a sheet of material that is produced can also be measured.

22 Claims, 7 Drawing Sheets

U.S. PATENT DOCUMENTS

| | | |
|---|---|---|
| 4,329,201 | 5/1982 | Bolton . |
| 4,369,080 | 1/1983 | Johnson . |
| 4,398,996 | 8/1983 | Bolton et al. . |
| 4,468,611 | 8/1984 | Tward . |
| 4,474,643 | 10/1984 | Lindblad . |
| 4,514,812 | 4/1985 | Miller et al. . |
| 4,535,285 | 8/1985 | Evans et al. . |
| 4,580,233 | 4/1986 | Parker et al. . |
| 4,588,943 | 5/1986 | Hirth . |
| 4,613,406 | 9/1986 | Gess . |
| 4,648,715 | 3/1987 | Ford, Jr. et al. . |
| 4,680,089 | 7/1987 | Aral et al. . |
| 4,692,616 | 9/1987 | Hegland et al. . |
| 4,707,779 | 11/1987 | Hu . |
| 4,748,400 | 5/1988 | Typpo . |
| 4,786,529 | 11/1988 | Boissevain . |
| 4,791,353 | 12/1988 | Typpo . |
| 4,817,021 | 3/1989 | Sowerby et al. . |
| 4,827,121 | 5/1989 | Vidrine, Jr. et al. . |
| 4,840,706 | 6/1989 | Campbell . |
| 4,845,421 | 7/1989 | Howarth et al. . |
| 4,903,528 | 2/1990 | Balakrishnan et al. . |
| 4,909,070 | 3/1990 | Smith . |
| 4,921,574 | 5/1990 | Hu . |
| 4,924,172 | 5/1990 | Homgren . |
| 4,947,684 | 8/1990 | Balakrishnan . |
| 4,957,770 | 9/1990 | Howarth . |
| 4,980,846 | 12/1990 | Chapman . |
| 4,986,410 | 1/1991 | Shields . |
| 4,990,261 | 2/1991 | Ho . |
| 4,994,145 | 2/1991 | Seymour . |
| 5,013,403 | 5/1991 | Chase . |
| 5,020,469 | 6/1991 | Boissevain et al. . |
| 5,021,740 | 6/1991 | Sarr et al. . |
| 5,022,966 | 6/1991 | Hu . |
| 5,045,798 | 9/1991 | Hendrick . |
| 5,052,223 | 10/1991 | Regnault et al. . |
| 5,067,345 | 11/1991 | Mougne . |
| 5,071,514 * | 12/1991 | Francis ..... 162/259 |
| 5,093,795 | 3/1992 | Lewis . |
| 5,122,754 | 6/1992 | Gotaas . |
| 5,124,552 | 6/1992 | Anderson . |
| 5,132,631 | 7/1992 | Klopfenstein et al. . |
| 5,134,380 | 7/1992 | Jonas . |
| 5,170,128 | 12/1992 | Masurat et al. . |
| 5,170,670 | 12/1992 | Fasching et al. . |
| 5,177,445 | 1/1993 | Cross . |
| 5,198,777 | 3/1993 | Masuda et al. . |
| 5,206,599 | 4/1993 | Mayer . |
| 5,208,544 | 5/1993 | McBrearty et al. . |
| 5,225,785 | 7/1993 | Mayer et al. . |
| 5,241,280 | 8/1993 | Aidun et al. . |
| 5,244,550 | 9/1993 | Inoue . |
| 5,247,261 | 9/1993 | Gershenfeld . |
| 5,262,955 | 11/1993 | Lewis . |
| 5,270,664 | 12/1993 | McMurtry et al. . |
| 5,280,250 | 1/1994 | Jayaweera et al. . |
| 5,300,193 | 4/1994 | Rule, Jr. et al. . |
| 5,340,442 | 8/1994 | Gess et al. . |
| 5,400,247 | 3/1995 | He . |
| 5,450,015 | 9/1995 | Mastico et al. . |
| 5,492,601 | 2/1996 | Ostermayer et al. . |
| 5,493,910 | 2/1996 | Hall et al. . |
| 5,539,634 | 7/1996 | He . |
| 5,561,599 | 10/1996 | Lu . |
| 5,563,809 | 10/1996 | Williams et al. . |
| 5,636,126 | 6/1997 | Heaven et al. . |
| 5,658,432 | 8/1997 | Heaven et al. . |

* cited by examiner

SYSTEM AND METHOD FOR SHEET MEASUREMENT AND CONTROL IN PAPERMAKING MACHINE

FIELD OF THE INVENTION

The present invention generally relates to techniques for monitoring and controlling continuous sheetmaking systems and, more specifically, to sensors and methods for (i) cross-direction weight measurement and control, (ii) dry weight cross-direction profile determination for paper that is produced and (iii) dry sheet weight calculation of the wet stock on the wire in the papermaking machine.

BACKGROUND OF THE INVENTION

In the art of making paper with modern high-speed machines, sheet properties must be continually monitored and controlled to assure sheet quality and to minimize the amount of finished product that is rejected when there is an upset in the manufacturing process. The sheet variables that are most often measured include basis weight, moisture content, and caliper (i.e., thickness) of the sheets at various stages in the manufacturing process. These process variables are typically controlled by, for example, adjusting the feed-stock supply rate at the beginning of the process, regulating the amount of steam applied to the paper near the middle of the process, or varying the nip pressure between calendaring rollers at the end of the process. Papermaking devices well known in the art are described, for example, in "Handbook for Pulp & Paper Technologists" 2nd ed., G. A. Smook, 1992, Angus Wilde Publications, Inc., and "Pulp and Paper Manufacture" Vol III (Papermaking and Paperboard Making), R. MacDonald, ed. 1970, McGraw Hill. Sheet-making systems are further described, for example, in U.S. Pat. Nos. 5,539,634, 5,022,966 4,982,334, 4,786,817, and 4,767,935.

On-line measurements of sheet properties can be made in both the machine direction and in the cross direction. In the sheetmaking art, the term machine direction (MD) refers to the direction that the sheet material travels during the manufacturing process, while the term cross direction (CD) refers to the direction across the width of the sheet which is perpendicular to the machine direction.

Papermaking machines typically have several control stages with numerous, independently-controllable actuators that extend across the width of the sheet at each control stage. For example, a papermaking machine will typically include a headbox having a plurality of slices at the front which allow the stock in the headbox to flow out on the fabric of the web or wire. The papermaking machine might also include a steam box having numerous steam actuators that control the amount of heat applied to several zones across the sheet. Similarly, in a calendaring stage, a segmented calendaring roller can have several actuators for controlling the nip pressure applied between the rollers at various zones across the sheet.

All of the actuators in a stage are operated to maintain a uniform and high quality finished product. Such control might be attempted, for instance, by an operator who periodically monitors sensor readings and then manually adjusts each of the actuators until the desired output readings are produced. Papermaking machines include control systems for automatically adjusting cross-directional actuators using signals sent from scanning sensors.

In making paper, virtually all MD variations can be traced back to high-frequency or low-frequency pulsations in the headbox approach system. CD variations are more complex.

Preferably, the cross-direction dry weight profile of the final paper product is flat, that is, the product exhibits no CD variation, however, this is seldom the case. Various factors contribute to the non-uniform CD drainage which ultimately results in fluctuations in the CD profile. These factors include, for example, (i) non-uniform headbox delivery, (ii) clogging of the plastic mesh fabric of the wire, (iii) varying amounts of tension on the wire, and (iv) uneven vacuum distribution.

Cross-directional measurements are typically made with a scanning sensor that periodically traverses back and forth across the width of the sheet material. Current technology in papermaking uses a beta type sensor that scans across the sheet during the manufacturing process to measure basis weight. The objective of scanning across the sheet is to measure the variability of the sheet in both CD and MD. Based on the measurements, corrections to the process are made to make the sheet more uniform. A difficulty with this measurement technique is that while the sensor scans across 30 to 40 feet of the sheet in the CD, 1000 to 2000 feet of paper have passed the sensor in the MD. This means that MD and CD information are mixed together during a scan. Further, the scanning sensor is capable of measuring only a small fraction of the paper produced. The "footprint" area covered by the scanning sensor is typically less than 1% of the total sheet surface. Another disadvantage is that the sheet shrinks as it dries, so corrections must be made to determine which actuator at the headbox will affect the location being measured.

To separate CD information from the mix, it is typical to filter the data from many scans to average out MD variations. With filtering, it takes several minutes to obtain an accurate CD profile. The MD information is usually extracted by using the average of all readings across the sheet, i.e., "scan average." While these methods have proven reliable and accurate over the years, the main disadvantage is that they are slow and only a small fraction of the sheet is actually measured.

As is apparent, there is a need in the art for effective methods of controlling and measuring the dry weight of paper in a papermaking machine especially the CD dry stock weight profile.

SUMMARY OF THE INVENTION

The present invention is based in part on the recognition that significant improvements in papermaking control can be achieved by employing an array of sensors cross the wire of a papermaking machine to measure the water weight of paper stock on the wire. In a preferred embodiment, the wet stock basis weight measurements are made with an array of underwire water weight sensors (referred to herein as the "$UW^3$" sensor) wherein each sensor is sensitive to three properties of materials: the conductivity or resistance, the dielectric constant, and the proximity of the material to the $UW^3$ sensor. Depending on the material being measured, one or more of these properties will dominate.

In a preferred embodiment, a plurality of $UW^3$ sensors are positioned underneath the wire of a papermaking machine to measure the conductivity of the aqueous wet stock. In this case, the conductivity of the wet stock is high and dominates the measurement of the $UW^3$ sensor. The conductivity of the wet stock is directly proportional to the total water weight within the wet stock; consequently, the sensor provides information which can be used to monitor and control the quality of the paper sheet produced. Because CD water weight profile obtained practically instantaneously, the MD and CD variations are essentially decoupled. Quality improvements to the sheet fabricated will be achieved by providing fast control of the actuators on the machine and by tuning components on the machine to eliminate the sources of variations. For example, the invention will make it possible to make more uniform paper. Another benefit of the invention is that measurement with the array of $UW^3$ sensors will continue even when there is a sheet break. This allows control to be maintained while the sheet is rethreaded in the machine.

In one aspect, the invention is directed to a system for controlling the cross-direction (CD) dry stock weight profile for a sheet of material that is being formed from wet stock on a de-watering machine that includes a water permeable moving wire supporting wet stock and a dry end, which system includes:

(a) a headbox having a plurality of slices through which wet stock is introduced onto the moving wire;

(b) an array of water weight sensor elements (array) that is positioned underneath and adjacent to the wire wherein the array of water weight sensor elements is positioned to extend transversely of the wire and the array generates first signals indicative of a CD water weight profile from wet stock on the wire that is made up of a multiplicity of water weight measurements at different locations in the cross direction;

(c) a second sensor that measures the dry stock weight of the sheet of material at the dry end;

(d) means for predicting the CD dry stock weight profile for a segment of material that is on the wire by obtaining CD water weight profile of the segment and for generating second signals that are indicative of the predicted CD dry stock weight; and (e) means for controlling the DC dry stock weight profile based on said second signals.

In another aspect, the invention is directed to a method of controlling the cross-direction (CD) dry stock weight of a sheet of material that is formed from wet stock in a process that employs a de-watering machine that includes a headbox comprising a plurality of slices through which wet stock is introduced onto a water permeable moving wire and a dry end which includes the steps of:

(a) positioning an array of water weight sensor elements (array) underneath and adjacent to the wire wherein the array is positioned perpendicular to the moving wire;

(b) operating the machine and measuring the water weights of the sheet of material with the array to generate a CD water weight profile;

(c) positioning a second sensor at the dry end to measure the CD dry stock weight of the sheet of material that is formed;

(d) predicting the CD dry stock weight profile for a sheet of material that is on the wire based on the CD water weight profile for the sheet of material; and (e) controlling the DC dry stock weight profile.

In another aspect, the invention is directed to a system for determining the dry stock weight of a sheet of wet stock that is resting on a water permeable moving wire of a de-watering machine, which system includes:

(a) means for measuring the weight of the wire;

(b) a water weight sensor element that is positioned adjacent to the wire and that generates signals indicative of the water weight of the sheet of wet stock on the wire;

(c) means for measuring the aggregate weight of the wire and of the sheet of wet stock on the wire; and (d) means for calculating the dry stock weight of the sheet of wet stock that is resting on the wire.

In another aspect, the invention is directed to a method of determining the dry stock weight of a sheet of wet stock that is on a water permeable moving fabric of a de-watering machine, which includes the steps of:

(a) measuring the weight of the wire;

(b) measuring the water weight of the sheet of wet stock on the wire with a water weight sensor that is positioned adjacent to the wire;

(c) measuring the aggregate weight of the wire and of the sheet of wet stock on the wire; and (d) calculating the dry stock weight by subtracting the weight of the wire and of the wet stock from the aggregate weight of the sheet of wet stock that is resting on the wire.

In another aspect, the invention is directed to a system for determining the dry stock weight along the cross direction (CD) of a sheet of material that is produced from wet stock in a de-watering machine that includes a water permeable moving wire supporting wet stock, a dry end, and a headbox having a plurality of slices through which wet stock is introduced onto the wire, which system includes:

(a) an array of water weight sensor elements that (array) is positioned adjacent to the wire wherein the array is positioned in a transverse direction to the moving wire and generates first signals that are indicative of water weight CD profile made up of a multiplicity of water weight measurements at different locations in the CD;

(b) a stationary sensor that is positioned at the dry end to measure the dry stock weight of a segment of the sheet of material that passes the stationary sensor, wherein the stationary sensor generates second signals that are indicative of the dry stock weight machine direction (MD) profile of the segment; and (c) means for developing a dry stock weight CD profile based on said first signal that are indicative of the water weight CD profile and said second signals that are indicative on the dry stock weight MD profile.

In a further aspect, the invention is directed to a method of determining the dry stock weight cross-direction (CD) profile of a sheet of material that is produced from wet stock in a process that employs a de-watering machine that includes a water permeable moving wire supporting wet stock and a dry end, which method includes the steps of:

(a) positioning an array of water weight sensor elements (array) adjacent to the wire wherein the array is positioned in a cross direction to the moving wire;

(b) positioning a stationary sensor at the dry end to measure the dry stock weight of a segment of the sheet of material that passes the stationary sensor and to measure the dry stock weight machine direction (MD) profile of the segment;

(c) providing means for developing a dry stock weight CD profile based on the water weight CD profile and said signals generated by the stationary sensor; and (d) operating the machine and obtaining the water weight CD profile and the dry stock weight MD profile to determine the dry stock weight CD profile.

In yet another aspect, the invention is directed to a system for determining the moisture along the cross direction (CD) of a sheet of material that is produced from wet stock in a de-watering machine that includes a water permeable moving wire supporting wet stock, a dry end, and a headbox having a plurality of slices through which wet stock is introduced onto the wire, which system includes:

(a) an array of water weight sensor elements that (array) is positioned adjacent to the wire wherein the array is positioned in a transverse direction to the moving wire and generates first signals that are indicative of water weight CD profile made up of a multiplicity of water weight measurements at different locations in the CD;

(b) a stationary sensor that is positioned at the dry end to measure the moisture level of a segment of the sheet of material that passes the stationary sensor, wherein the stationary sensor generates second signals that are indicative of the moisture level machine direction (MD) profile of the segment; and (c) means for developing a moisture level CD profile based on said first signal that are indicative of the water weight CD profile and said second signals that are indicative on the moisture level MD profile.

In still another aspect, the invention is directed to a method of determining the moisture level cross-direction (CD) profile of a sheet of material that is produced from wet stock in a process that employs a de-watering machine that includes a water permeable moving wire supporting wet stock and a dry end, which method includes the steps of:

(a) positioning an array of water weight sensor elements (array) adjacent to the wire wherein the array is positioned in a cross direction to the moving wire;

(b) positioning a stationary sensor at the dry end to measure the moisture level of a segment of the sheet of material that passes the stationary sensor and to measure the moisture level machine direction (MD) profile of the segment;

(c) providing means for developing a moisture level CD profile based on the water weight CD profile and said signals generated by the stationary sensor; and (d) operating the machine and obtaining the water weight CD profile and the moisture level MD profile to determine the moisture level CD profile.

DETAILED DESCRIPTION OF PREFERRED EMBODIMENTS

The present invention employs a system that includes an array of sensors that measure water weight across of the wet stock on the wire at the wet end of a papermaking machine, e.g., fourdrinier. These $UW^3$ sensors have a very fast response time (1 msec) and since there is an array of them, a substantially instantaneous CD profile of water weight can be obtained. The system therefore does not mix MD and CD information and is capable of measuring the entire sheet to at least 1 in. by 1 in. resolution. Since there is practically no sheet (width) shrinkage at the wet end, measurements at the array elements can be traced directly to control actuators on the headbox. The $UW^3$ sensor generates a signal which is proportional to the amount of water on the wire which in turn is proportional to the amount of fibers (e.g., paper stock) present. However, this measurement is not absolute in that the final dry weight of the paper produce will vary depending on the overall operating conditions. Indeed, the same water weight measurement during different times of operation may produce different grades of paper. Therefore, as further explained herein, a sensor at the dry end is employed to calibrate the $UW^3$ sensors.

The term "water weight" refers to the mass or weight of water per unit area of the wet paper stock which is on the wire or web. Typically, the water weight sensors are calibrated to provide engineering units of grams per square meter (gsm). As an approximation, a reading of 10,000 gsm corresponds to paper stock having a thickness of 1 cm on the fabric. The term "dry weight" or "dry stock weight" refers to the weight of a material (excluding any weight due to water) per unit area. The term "basis weight" refers to the total weight of the material per unit area.

Figure 2A:
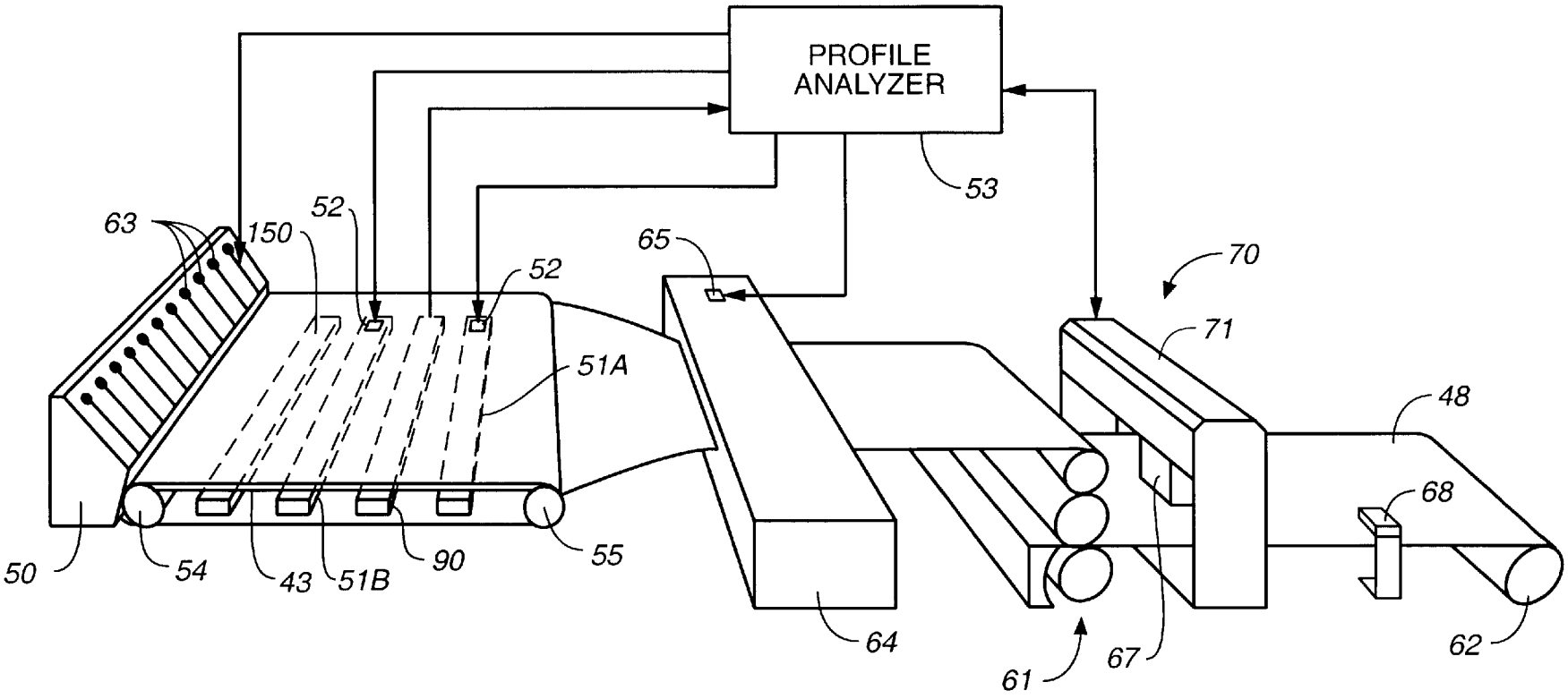
FIG. 2A shows a papermaking system implementing the technique of the present invention.
Figure 2B:
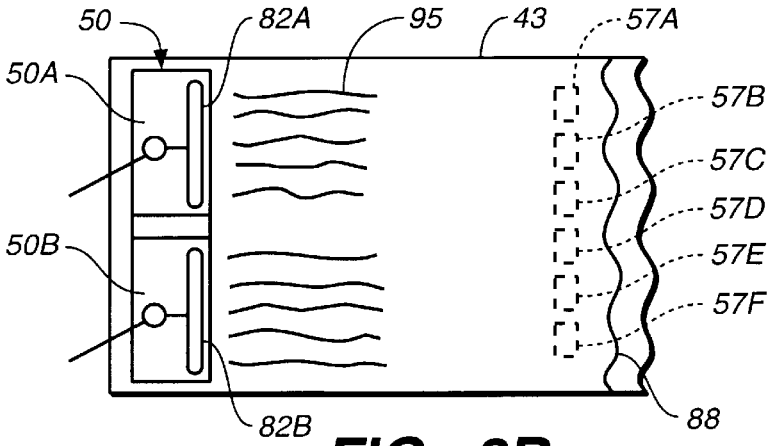
FIG. 2B shows the positioning of an array of underwater wire weight sensors in relationship to slices in the headbox.
Figure 2C:
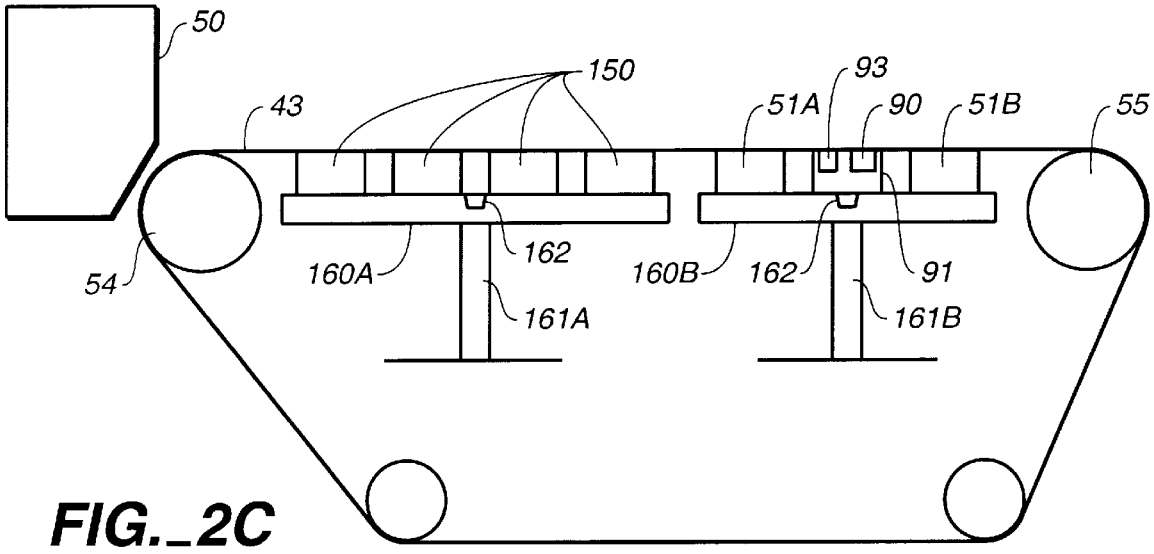
FIG. 2C shows a cross-sectional view of the wet end of the papermaking machine.

In FIGS. 2A and 2C, a system for producing continuous sheet material includes processing stages including a headbox 50, a calendaring stack 61 and reel 62. Actuators 63 in headbox 50 discharge wet stock material through a plurality of slices onto supporting web or wire 43 which rotates between rollers 54 and 55. Foils 250 and vacuum boxes 51A and 51B remove water from the material on the wire. The vacuum boxes may have a plurality of actuators 52 which can vary the strength of the vacuum cross each vacuum box. Sheet material exiting the wire passes through a dryer 64 which includes actuator 65 that can vary the temperature of the dryer. A scanning sensor 67, which is supported on supporting frame 71, continuously traverses the sheet and measures properties of the finished sheet in the cross direction. In an alternative embodiment, a stationary sensor 68 that measures the dry stock weight basis weight or moisture is employed instead. The finished sheet product 48 is then collected on reel 62. As used herein, the "wet end" portion of the system depicted in FIG. 2A includes the headbox, the web, and those sections just before the dryer, and the "dry end" comprises the sections that are downstream from the dryer. Typically, the two edges of the wire in the cross direction are designated "front" and "back" with the back side being adjacent to other machinery and less accessible than the front side.

An array 90 of the $UW^3$ sensors is positioned underneath web 43; by this meant that each sensor is positioned below a portion of the web which supports the wet stock. As further described herein, each of the sensors is configured to measure the water weight of the sheet material as it passes over the array. The array provides a continuous measurement of the entire sheet material along the CD direction at the point where it passes the array. A profile made up of a multiplicity of water weight measurements at different locations in the CD is developed.

In operation of the system, a sheet of finished product is traversed from edge to edge by scanning sensor 67 at a generally constant speed during each scan. The time required for a typical scan is generally between twenty and thirty seconds. The rate at which measurement readings is provided by such scanners is usually adjustable; however, a typical rate is about one measurement reading every 6.25 milliseconds. The scanning sensor is typically controlled to travel at a rate of about 16 inches per second across the sheet. Multiple stationary sensors could also be used. Scanning sensors are known in the art and are described, for example, in U.S. Pat. Nos. 5,094,535, 4,879,471, 5,315,124, and 5,432,353, which are incorporated herein. Such apparatus conventionally uses a gauge mounted on a scanning head which is repetitively scanned transversely across the web. The gauges can use a broad-band infra-red source and one or more detectors with the wavelength of interest being selected by a narrow-band filter, for example, an interference type filter. The gauges used fall into two main types: the transmissive type in which the source and detector are on opposite sides of the web and, in a scanning gauge, are scanned in synchronism across it, and the scatter type (sometimes called "reflective" type) in which the source and detector are in a single head on one side of the web, the detector responding to the amount of source radiation scattered from the web.

Another type of scanning sensor is the nuclear gauge which directs nuclear radiation (beta rays) against a surface of a traveling web while detecting the transmitted radiation. (The quantity of nuclear radiation absorbed over a given area is a measure of the basis weight of the absorbing material.) Nuclear scanning gauges often use radioactive krypton 85 gas or promethium 147 as the beta-ray source. A preferred scanning sensor for the inventive system employs a beta type sensor, and is available from Honeywell-Measurex, Inc., Cupertino, Calif.

As shown in FIG. 2A, the system further includes a profile analyzer 53 that is connected, for example, to scanning sensor 70 and actuators 65, 51, and 63 on the dryer, vacuum boxes, and headbox, respectively. The profile analyzer is a signal processor which includes a control system that operates in response to the cross-directional measurements from sensor array 90 and scanner 70. In operation, scanning sensor 70 provides the analyzer with signals that are indicative of the magnitude of a measured sheet property (e.g., caliper or dry basis weight) at various cross-directional measurement points. Concurrently, the array of $UW^3$ sensors provides the analyzer with the CD water weight profile. The analyzer also include means for controlling the operation of various components of the sheetmaking system, including, for example, the above described actuators.

FIG. 2B illustrates headbox 50 having two slices 50A and 50B which discharge wet stock 95 onto wire 43 and a CD array of $UW^3$ sensors which, for illustrative purposes, includes six sensors (57A through 57F). In actual papermaking systems, the number of slices in the headbox and sensors is much higher. For instance, for a headbox that is 300 inches in length, there can be 300 or more slices. The rate at which wet stock is discharged through the nozzles 82A and 82B of the slices can be controlled by corresponding actuators 53A and 53B, respectively. As the web moves from the headbox toward the sensor array, wet stock discharged from nozzle 82A will be measured by sensors 57A, 58B, and 58C, and similarly, wet stock discharged from nozzle 82B will be measured by sensors 57D, 57E, and 57F. As is apparent, the number of sensors corresponding to each slice will depend in part on their relative sizes, that is, if the sensors are configured smaller to achieve higher resolution, then more sensors can be employed. The array of sensors is positioned upstream from dry line 88 that develops during the dewatering process.

In one embodiment, the profile analyzer 53 applies data of the $UW^3$ CD profile and scanner dry weight to generate control information to adjust for processing variations in the CD direction. For instance, the amount of wet stock discharged through the nozzles can be regulated by actuators 53A and 53B. This can be achieved by developing a model that simulates the behavior the wet stock on the wire to predict the CD dry stock weight profile based on water weight measurements at the wire as further described herein.

It has been demonstrated that fast variations of water weight on the wire correlate well to fast variations in dry basis weight of the sheet material produced when the water weight is measured upstream from the dry line on the wire. The reason is that essentially all of the water on the wire is being held by the paper fibers. Since more fibers hold more water, the measured water weight correlates well to the fiber weight. To use water weight on the wire as an accurate indicator of fiber weight, the calibration is periodically adjusted. The reason for the adjustments is that the relationship between the fiber weight and the water weight will vary as process parameters fluctuate. These parameters include, for example: 1) wire speed, 2) refining, 3) retention aids, 4) wire wear, and 5) fiber type. Since these factors vary relatively slowly, each calibration will hold for several minutes. The scanning sensor provides an accurate measurement of fiber weight on a slow time scale, so the water weight to fiber weight calibration can by periodically adjusted. The adjusted water weight measurement then provides a fast, accurate, and high resolution fiber weight measurement of the entire sheet.

Because of the high volume of data produced at the higher resolution (e.g., 1 in. by 1 in.) of the system, it is expected that under normal circumstances, lower MD resolution could be used. That is, CD profiled would be taken at MD intervals greater than 1 inch. However, there are still advantages to the system used with lower MD resolution. Since the CD profile is measured substantially instantaneously, MD variations are not mixed in with the CD measurement. The instantaneous CD profiles are substantially completely decoupled from MD variations.

The calibration is achieved, for example, by correlating approximately 3 minute averages of dry basis weight as measured by the scanning sensor 67 near reel 62 to averages over the same time period of water weight on the wire as measured by the array. Regression analysis of the last 10 averages then would use 30 minutes of data to maintain the correct slope and intercept for the calibration. The sensor array can then provide accurate dry basis weight at up to 600 readings per second.

Another method is to average the dry weight from the scanning sensor on a slice by slice basis and the water weight data for each element of the array. Regression is done between data from each slice (e.g., 82A) and the data from the corresponding array sensors (e.g., 57A, 57B, and 57C). A separate slope and intercept is applied to each set of sensors. One advantage of this method is that factors such as uneven wire wear across the machine can be calibrated out of the final reading. Moreover, by monitoring the differences in calibration, the operators will be alerted when wire wear is excessive.

CD Water Weight Profile. Many factors contribute to the shape of the CD water weight profile as measured by the CD array of $UW^3$ sensors. These wet end factors include, for example: (1) the machine direction (MD) variation of the water weight, (2) the cross-direction (CD) variation in paper stock flow (3) variation in CD drainage, (4) CD variation of the consistency, and (5) the sheet forming hydrodynamic processes.

Figure 7A:
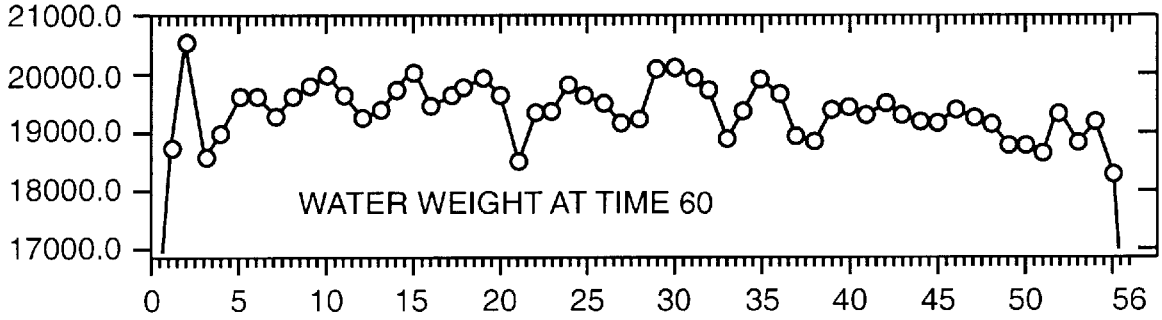
FIGS. 7A and 7B are two CD water weight profiles measured at different time intervals.
Figure 7B:
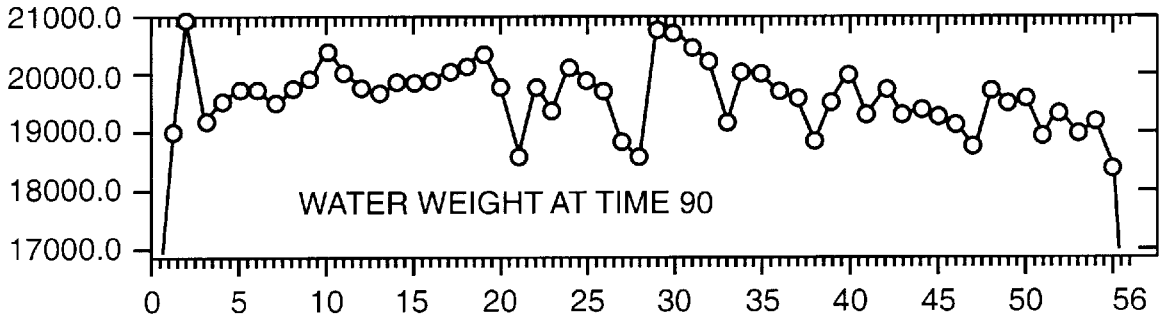

Machine Direction Variation. With respect to MD variation of the water weight profile, it has been observed that the overall shape of the CD water weight profile will remain constant despite MD variations. FIG. 7A is a CD water weight profile that was measured in a papermaking machine with an CD array of $UW^3$ sensors. The water weight is measured in grams per $m^2$ (gsm) and the position on the wire in the cross direction (y axis) corresponds the sensor number (56 in total) positioned under the wire. FIG. 7B is the same measurement taken 30 seconds later with no changes in the operating parameters of the machine during the interim. As is apparent, while the water weight profile in the second measurement has an overall higher water weight reading the contours of the two profiles are very similar. This suggests that time variations affect each CD slice in the headbox to substantially the same degree and essentially at the same time.

Figure 8:
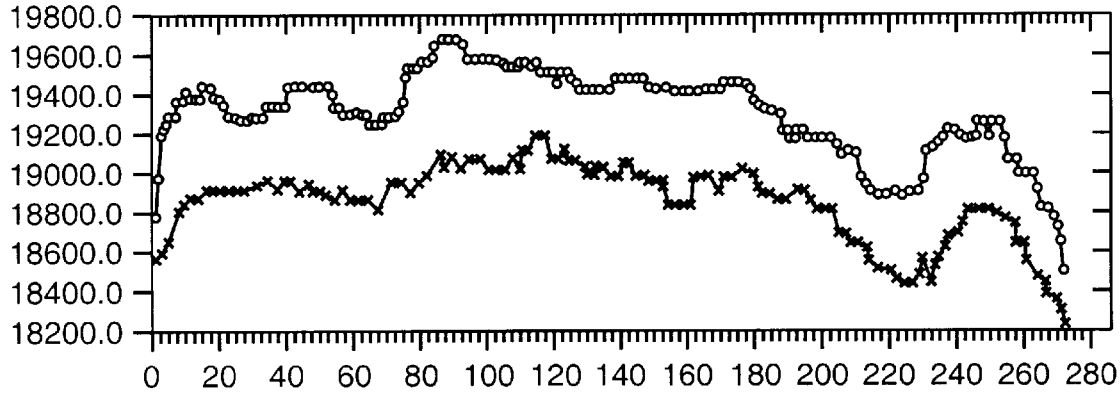
FIG. 8 is a graph of MD water weight profiles measured at different slice positions.

This observation pertaining to the behavior of wet stock on the wire is confirmed in FIG. 8 which is a graph of MD water weight profiles measured at different slice positions 7 (top curve) and 28 (bottom curve) for about 270 seconds of operation. The two profiles were measured with $UW^3$ sensors corresponding to sensors 3, 19, and 32. As is apparent, although the absolute levels of the water weight are different the contours of the profiles were similar.

Cross-Direction Variation of the Water Weight. CD variation refers to differences in the paper stock flow rates through the slices at the headbox. Any non-uniformity in the flow rates at the slices affects the signal is detected by the $UW^3$ sensors.

Non-uniform CD Drainage Profile Across the Wire. Drainage of water is not uniform across the wire. The nonuniformity is caused by CD differences in the wire tension, cleanness of the wire, vacuum box, chemicals applied to the weight water and headbox delivery system. Uniform and stable CD drainage on the wire is essential to producing paper having good CD uniformity at the dry end.

The CD array of $UW^3$ sensors mounted before the dryline region can be employed to measure the CD drainage profile on the wire and the profile can be used for feed forward and/or feed back control.

Software Specification. The following is the software specification for calculating the predicted dry weight CD profile at the wire based on measurements from the $UW^3$ CD profile and the scanner dry weight profile at the reel. The specification is particularly suited for execution with a microprocessor using LABVIEW 4.0.1 software from National Instrument (Austin, Tex.).

A. History Buffers. Two history buffers (HB) are used to store both the Water Weight CD Raw Profile WWCDX(j) and Scanner Dry Weight Profile continuously whenever new Water Weight (WW) or Dry Weight (DW) profiles are being produced. Since the water weight profile and scanner dry weight profile may not have the same size, it is essential to apply a profile transformation on the dry weight mini profile before engaging in any profile calculations in between the water weight and dry weight from the scanner. The CD Raw Profile WWCDX(j) is updated once every second and the Dry Weight Profile is updated at the end of the scan (EOS) which is about every 20 seconds; thus, the CD RAW Profile WWCDX(j) will be an average for the end of scan (EOS) period before storing it in the history buffer. ASCII "H" was used in variable names to indicate that they are calculated directly from the history buffer. Both history buffers are structured as a circular queue with enough cells to hold last 10 minutes of data. Since the history buffers are circular queues, the oldest data will be replaced by new data when the history buffers are filled up. The definitions and calculations of variables associated with both WW and DW history buffers are specified as below. As used herein, the symbol "%" refers to percent/100.

(1) WIndexHB: Index used to point to the cell on the water weight history buffer where the newest WW CD Raw Profile is stored.

(2) WInOfsHB: Index offset to apply to the WW history buffer. It is used to account (or adjust) for process delay time from the $UW^3$ CD array at the wire to the dry scanner at the reel plus half of the EOS time. This variable is typically an on-site configuration datum which depends on the particular papermaking machine.

(3) DIndexHB: Index used to point to the cell on the scanner dry weight history buffer where the newest DW CD Profile was stored.

(4) AWWCDH(j): Slice average of water weight CD profiles stored on the history buffer. Both WindeHB and WinOfsHB are used in the calculation of AWWCDH(j).

(5) AVGWWH: Average of profile AWWCDH(j) and it is a singleton floating point variable.

(6) AWW%CDH(j): Slice average of the water weight CD profile in % from the history buffer, and it is calculated as:

AWW%CDH(j))=[AWWCDJ(j)−AVGWWH]/AVGWWH (7) ADWCDH(j): Slice average of scanner dry weight CD profiles stored on the history buffer. Index DindexHB is used in the calculation of ADWCDH(j).

(8) AVGDWH: Average of profile ADWCDH(j) and it is a singleton floating point variable.

(9) ADW%CDH(j): Slice average of the scanner dry weight CD profiles in % from the history buffer, and it is calculated as:

ADW % CDH(j)=[ADWCDH(j)−AVGDWH]/AVGDWH.

B. Drainage and Sheet Forming Adjustment

Non-uniform drainage and sheet forming adjustment of the $UW^3$ CD raw profile are described herein. The adjusted water weight CD raw profile in % is represented by WW%CDXX(j); "XX" indicating that it is being adjusted and is calculated as follows:

WW%CDXX(j)={[WW%CDX(j)−BBWW%CDH(j)] *SHTFFH((j)}+BBDW%CDH(j).

(1) WW%CDX(j): The Water Weight CD raw profile in % and it is calculated as: [WWCDX(j)−WWLAVGX]/WWLAVGX.

WWCDX(j) is the water weight CD raw profile as defined above, and WWLAVGX is the last average of the water weight CD raw profile WWCDX(j).

(2) BBWW%CDH(j): The Backbone of Water Weight CD Long-term Average Profile that is saved in the history buffer and is defined as:

BBWW%CDH(j)=Median {AWW%CDH(j)}.

AWW%CDH(j) is defined above. Standard NI VI "Median" is used to smooth out CD variations locally on the profile AWW%CDH(j) across the whole wet sheet to generate the desired backbone of the water weight CD profile. Database enterable Parameter RANK for the VI "median" is used to define the size of the local area on the profile for the smooth operation.

(3) BBDW%CDH(j): The Backbone of the Scanner Dry Weight CD Long-term Average Profile from the history buffer and is defined as:

BBDW%CDH(J)=Median {ADW%CDH(j)}.

ADW%CDH(j) is defined above. Refer to the previous description for the backbone calculation for the long-term average scanner dry weight profile. It should be noted that the rank used on "Median" calculation here should be independent of the one used in backbone calculation for the water weight.

(4) SHTFFH(j): The sheet Forming Factor which is a single floating point variable. It is calculated from both the CD water weight and scanner dry weight history and is defined as:

SHTFFH(j)={|ADW%CDH(j)|}/{|(AWW%CDH(j)|}.

ADW%CDH(j) and AWW%CDH((j) are defined above and |ADW%CDH(j)| is the absolute value of ADW%CDH(j).

C. Predicted Dry Weight CD Raw Profile at Wire

The predicted dry water weight CD raw profile PDWCDXX(j) is:

PDWCDXX(j)={WWLAVGX*[1+WW%CDXX(j)]}*[AVGDWH/AVGWWH].

WW%CDXX(j) is the adjusted water weight CD raw profile in % and WWLAVGX is the average of the water weight CD raw profile WWCDX (j). AVGDWH and AVGWWH are total averages of the profiles that are stored in the history buffers as described above.

D. Consistency Profile in the CD on the Wire

The consistency profile CONSISH(j) in the CD on the wire which is used as a reference is:

CONSISH(j)={AVGDWH*[1+BBDW%CDH(j)]}/{AVGWWH*[1+BBWW%CDH(j)]}.

BBDW%CDH(j) and BBWW%CDH (j), respectively, are the backbone of the dry weight and water weight long-term average profiles from the history buffers.

E. Double Digital Filters. Based on the observation that the CD variation is minimal or very stable but that the MD variation is extremely large in water weight measurements, a double digital filter for the $UW^3$ CD profile is developed for CD control. Two new inputs calculated from the predicted dry weight CD profile PWDCDXX(j), are specified as follows:

PDWLAVGXX: Last average of the predicted dry weight raw profile PWDCDXX(j).

PDW%CDXX(j): The predicted dry weight CD raw profile in % which is defined as:

PDW %CDXX(j)=[PWDCDXX(j)−PDWLAVGXX]/PDWLAVGXX.

Two independent digital filters were applied to PDWLAVGXX and PDW%CDXX((j), respectively. Filtering methods are further described in H. T. Hu, U.S. Pat. No. 4,707,779, which is incorporated by reference. A suitable filter is a conventional exponential filter. A heavy digital filter is applied to the MD last average PDWLAVGXX and its filtered values are represented by PDWLAVGYY. A light digital filtering is applied to the CD raw % profile PDWCD%XX(j) and its filtered profile is represented by PDWCD%YY (j). The final results of the filtered $UW^3$ predicted dry weight at the wire are calculated as:

PDWCDYY((j)=PDWLAVGYY*[1+PDW%CDYY((j)].

The essence of a double digital filter is to remove MD variations as completely as possible to reach the predicted dry weight but still maintain measurement sensitivity to CD variations.

Degree of Sheet Forming at the Wire. A sheet of fibers forms rapidly as the paper stock (also known as "white water") travels on the wire from the slice at the headbox to the dryline. Fibers deposit on the wire as water is drained through the wire. As a result, the consistency of the white water next to the wire is higher than that at the upper surface. The difference between white water consistency at the surface and its overall average can be used to indicate the degree of sheet forming at a particular location on the wire. Maintaining stable and CD uniform sheet forming at an optimized level on the wire is essential to produce paper with both good MD and CD qualities at the dry end.

From the water weight profile measured by the CD array of $UW^3$ sensors mounted before the dryline and from the dry weight profile measured from scanning sensors at the reel, the degree of sheet forming can be calculated. This information can be used for feedback control of the water weight CD profile. For example, the CD drainage compensation to the CD water weight profile can be obtained by adding the CD drainage profile as described further herein.

Determination of Dry Weight or Moisture CD Profile Without Scanning Sensor at Reel As described above, the data from graphs 7A and 7B demonstrate that the overall contour of the CD water weight profile will remain relatively constant with time. Since the amount of water on the wire is proportional to the amount of fiber in the paper stock, it is expected that the shape of the dry weight and moisture profiles of the paper produced will be essentially the same as that of the paper stock on wire as measured by the CD array of water weight sensors. By positioning a stationary sensor 68, e.g., reflective or transmission type, as shown in FIG. 2A, the dry stock weight or moisture level at the reel can be continuously measured. This information when combined with the CD water weight profile ascertained at the wire will yield the basis weight or moisture measurement profile for the paper made. Specifically, the profile of the paper will be the same as that of the CD water weight profile but calibrated in accordance with either the basis weight or moisture measurements.

Determination of Sheet Dry Weight on the Wire

Figure 2D:
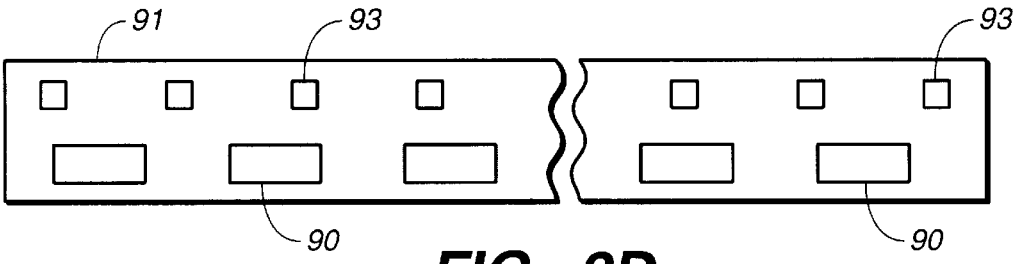
FIG. 2D shows a top view of a panel comprising a CD array of $UW^3$ sensors and a CD array of mass sensors.

Another aspect of employing the inventive water weight sensors is that one can ascertain the dry weight of paper stock on the wire without employing a scanning sensor at the reel. FIG. 2C shows a wire of the papermaking machine which includes headbox 50 from which paper stock is discharged onto wire 43. Positioned underneath the upper section of the wire that is supporting the paper stock between breast roller 54 and couch vacuum roller 55 are a plurality of foils 150, and a plurality of vacuum boxes 51A and 51B. The vacuum box 51A which is closer to the headbox generally will have lower vacuum strengths than vacuum box 51B which is further away. The dry line will typically formed above vacuum box 51B. A CD array of water weight sensors 90, which is supported by panel 91 is preferably positioned just before vacuum box 51B. As shown in FIG. 2D, panel 91 also includes a CD array of mass sensors 93 which can measure the total mass of the wire and paper stock (including fiber and water) during operation of the wet end. Preferred mass sensors include x-ray and beta type sensors which are known in the art. The mass sensors can be positioned in the foils, vacuum boxes, or other appropriate positions instead.

Using one or more of the mass sensors, the total mass of a segment of wire and associated paper stock supported by the segment can be measured. The entire wire and sheet of paper stock supported by the wire in turn can be extrapolated from the initial measurements. In the usual case where the total mass of the entire wire is entire, employing sensors in the MD will provide more precise measurements since there is a gradient in the water in the paper stock in the MD.

As shown in FIG. 2C, the foils 150, vacuum boxes 51A and 51B, and panel 91 are supported by appropriate structures such as beams 160A and 160B and posts 161A and 161B. Each beam includes an embedded weight sensor 162 which measures the weight that is being supported by the beam. The weight sensor can be a conventional load cell which includes a transducer that produces a voltage signal which is proportional to the force applied. By employing one or more of these weight sensors, the weight of the wire itself can be measured. This is accomplished by first taring the system to account for the weight of the system, e.g., foils, vacuum boxes and panel. Thereafter, once the wire is positioned on the system, its weight can be measured directly by the weight sensors, e.g., loan cell.

The water weight of the paper stock on the wire can be measured by employing one or more sensors, preferably the $UW^3$ sensors of the present invention. More precise measurements can be obtained by employing multiple sensors. In one embodiment, an CD array of the sensors are used.

Finally, the dry weight of a sheet of paper stock or segments thereof on the wire is the difference between (1) the total mass (i.e., wire, fiber, and water) as measured by the mass cells and (2) the sum of the (a) wire weight as measured by the load cells and (b) water weight as measured by the $UW^3$ sensors.

Under Wire Water Weight ($UW^3$) Sensor

Figure 1B:
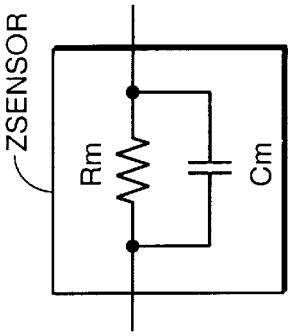
FIG. 1A shows a basic block diagram of the under wire water weight ($UW^3$) sensor and 1B shows the equivalent circuit of the sensor block.
Figure 1A:
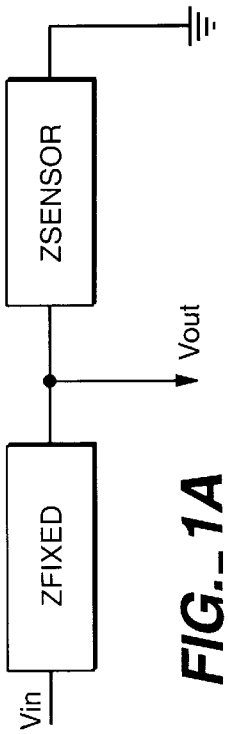

In its broadest sense, the sensor can be represented as a block diagram as shown in FIG. 1A, which includes a fixed impedance element (Zfixed) coupled in series with a variable impedance block (Zsensor) between an input signal (Vin) and ground. The fixed impedance element may be embodied as a resistor, an inductor, a capacitor, or a combination of these elements. The fixed impedance element and the impedance, Zsensor, form a voltage divider network such that changes in impedance, Zsensor, results in changes in voltage on Vout. The impedance block, Zsensor, shown in FIG. 1A is representative of two electrodes and the material residing between the electrodes. The impedance block, Zsensor, can also be represented by the equivalent circuit shown in FIG. 1B, where Rm is the resistance of the material between the electrodes and Cm is the capacitance of the material between the electrodes. The sensor is further described in U.S. patent application Ser. No. 08/766,864 filed on Dec. 13, 1996, which is incorporated herein.

As described above, wet end BW measurements can be obtained with one or more $UW^3$ sensors. Moreover, when more than one is employed, preferably the sensors are configured in an array.

The sensor is sensitive to three physical properties of the material being detected: the conductivity or resistance, the dielectric constant, and the proximity of the material to the sensor. Depending on the material, one or more of these properties will dominate. The material capacitance depends on the geometry of the electrodes, the dielectric constant of the material, and its proximity to the sensor. For a pure dielectric material, the resistance of the material is infinite (i.e. $Rm=\infty$) between the electrodes and the sensor measures the dielectric constant of the material. In the case of highly conductive material, the resistance of the material is much less than the capacitive impedance (i.e. $Rm \ll Z_{Cm}$), and the sensor measures the conductivity of the material.

To implement the sensor, a signal Vin is coupled to the voltage divider network shown in FIG. 1A and changes in the variable impedance block (Zsensor) is measured on Vout. In this configuration the sensor impedance, Zsensor, is: Zsensor=Zfixed*Vout/(Vin−Vout) (Eq. 1). The changes in impedance of Zsensor relates physical characteristics of the material such as material weight, temperature, and chemical composition. It should be noted that optimal sensor sensitivity is obtained when Zsensor is approximately the same as or in the range of Zfixed.

Cell Array

Figure 4A:
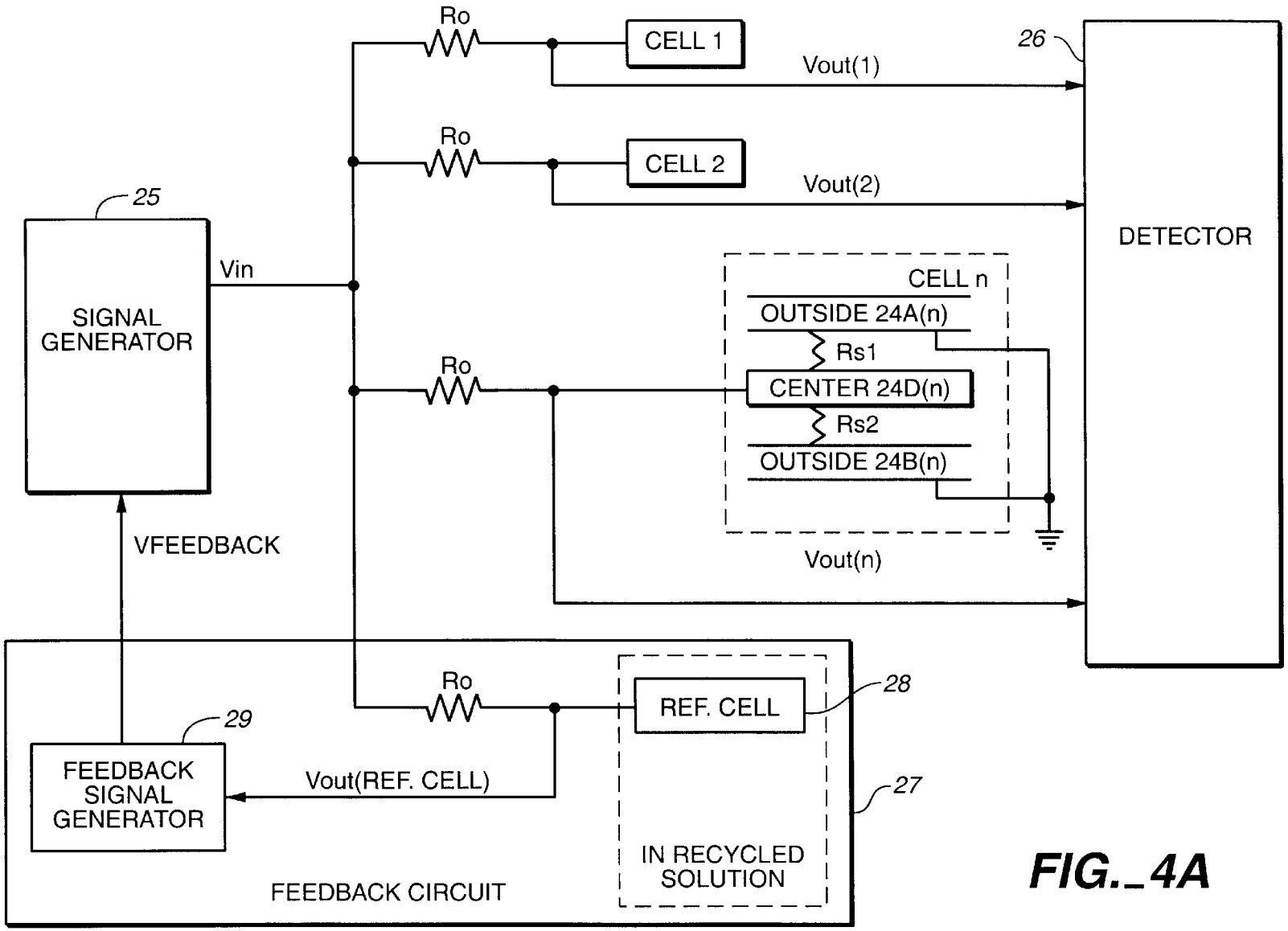
FIG. 4A shows an electrical representation of an embodiment of the $UW^3$ sensor.
Figure 4B:
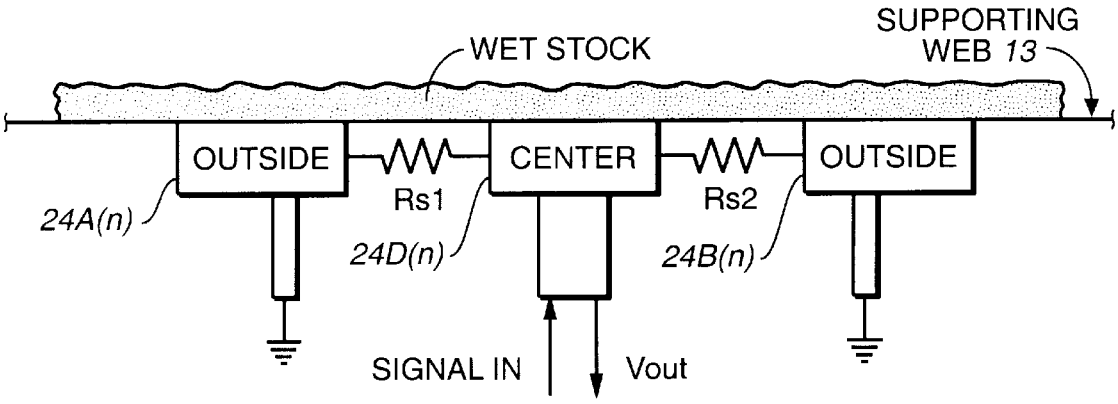
FIG. 4B shows a cross-sectional view of a cell used within the $UW^3$ sensor and its general physical position within a sheetmaking system in accordance with one implementation of the sensor.

FIG. 4A shows an electrical representation of cell array 24 (including cells 1−n) and the manner in which it functions to sense changes in conductivity of the aqueous mixture. As shown, each cell is coupled to Vin from signal generator 25 through an impedance element which, in this embodiment, is resistive element R0. Referring to cell n, resistor R0 is coupled to the center sub-electrode 24D(n). The outside electrode portions 24A(n) and 24B(n) are both coupled to ground. Also shown in FIG. 4A are resistors Rs1 and Rs2 which represent the conductance of the aqueous mixture between each of the outside electrodes and the center electrode. The outside electrodes are designed to be essentially equidistant from the center electrode and consequently the conductance between each and the center electrode is essentially equal (Rs1=Rs2=Rs). As a result, Rs1 and Rs2 form a parallel resistive branch having an effective conductance of half of Rs (i.e. Rs/2). It can also be seen that resistors R0, Rs1, and Rs2 form a voltage divider network between Vin and ground. FIG. 4B also shows the cross-section of one implementation of a cell electrode configuration with respect to a sheetmaking system in which electrodes 24A(n), 24B(n), and 24D(n) reside directly under the web 13 immersed within the aqueous mixture.

The sensor apparatus is based on the concept that the resistance Rs of the aqueous mixture and the weight /amount of an aqueous mixture are inversely proportional. Consequently, as the weight increases/ decreases, Rs decreases/increases. Changes in Rs cause corresponding fluctuations in the voltage Vout as dictated by the voltage divider network including R0, Rs1, and Rs2.

The voltage Vout from each cell is coupled to detector 26. Hence, variations in voltage directly proportional to variations in resistivity of the aqueous mixture are detected by detector 26 thereby providing information relating to the weight and amount of aqueous mixture in the general proximity above each cell. Detector 26 may include means for amplifying the output signals from each cell and in the case of an analog signal will include a means for rectifying the signal to convert the analog signal into a DC signal. In one implementation well adapted for electrically noisy environments, the rectifier is a switched rectifier including a phase lock-loop controlled by Vin. As a result, the rectifier rejects any signal components other than those having the same frequency as the input signal and thus provides an extremely well filtered DC signal. Detector 26 also typically includes other circuitry for converting the output signals from the cell into information representing particular characteristics of the aqueous mixture.

FIG. 4A also shows feedback circuit 27 including reference cell 28 and feedback signal generator 29. The concept of the feedback circuit 27 is to isolate a reference cell such that it is affected by aqueous mixture physical characteristic changes other than the physical characteristic that is desired to be sensed by the system. For instance, if water weight is desired to be sensed then the water weight is kept constant so that any voltage changes generated by the reference cell are due to physical characteristics other than water weight changes. In one embodiment, reference cell 28 is immersed in an aqueous mixture of recycled water which has the same chemical and temperature characteristics of the water in which cell array 24 is immersed in. Hence, any chemical or temperature changes affecting conductivity experienced by array 24 is also sensed by reference cell 28. Furthermore, reference cell 28 is configured such that the weight of the water is held constant. As a result voltage changes Vout(ref. cell) generated by the reference cell 28 are due to changes in the conductivity of the aqueous mixture, not the weight. Feedback signal generator 29 converts the undesirable voltage changes produced from the reference cell into a feedback signal that either increases or decreases Vin and thereby cancels out the affect of erroneous voltage changes on the sensing system. For instance, if the conductivity of the aqueous mixture in the array increases due to a temperature increase, then Vout(ref. cell) will decrease causing a corresponding increase in conductivity of the aqueous mixture in the array increases due to a temperature increase, then Vout(ref. cell) will decrease causing a corresponding increase in the feedback signal. Increasing Vfeedback increases Vin which, in turn, compensates for the initial increase in conductivity of the aqueous mixture due to the temperature change. As a result, Vout from the cells only change when the weight of the aqueous mixture changes.

Figure 3:
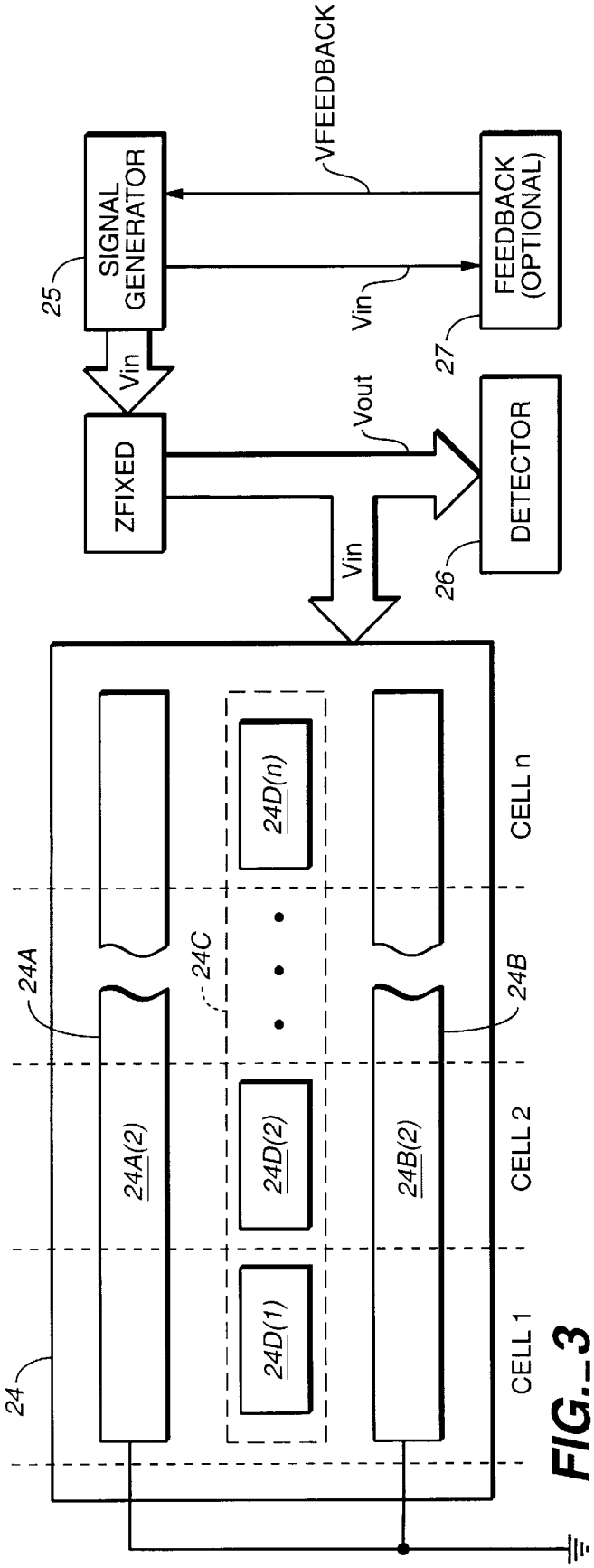
FIG. 3 shows a block diagram of the $UW^3$ sensor including the basic elements of the sensor.
Figure 5A:
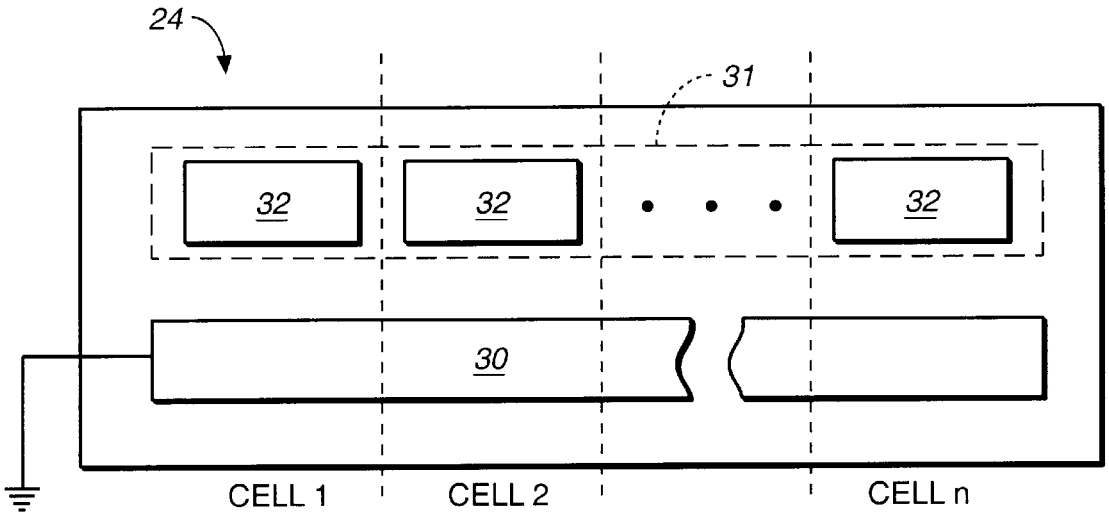
FIG. 5A shows a second embodiment of the cell array used in the $UW^3$ sensor.
Figure 5B:
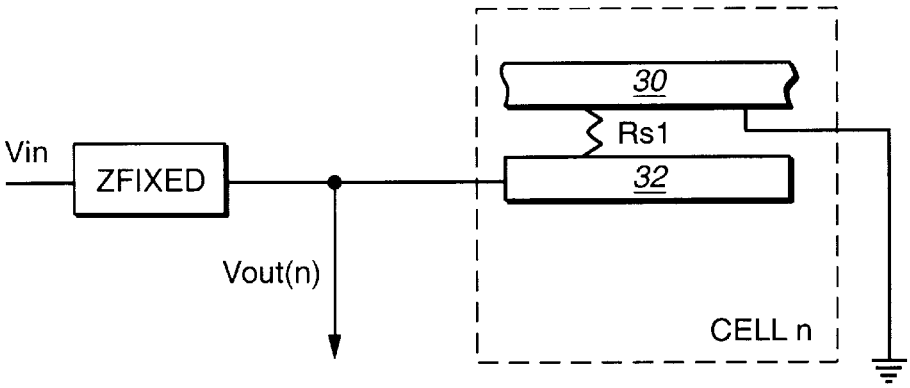
FIG. 5B shows the configuration of a single cell in the second embodiment of the cell array shown in FIG. 5A.

One reason for configuring the cell array as shown in FIG. 3, with the center electrode placed between two grounded electrodes, is to electrically isolate the center electrode and to prevent any outside interaction between the center electrode and other elements within the system. However, it should also be understood that the cell array can be configured with only two electrodes. FIG. 5A shows a second embodiment of the cell array for use in the sensor. In this embodiment, the sensor includes a first grounded elongated electrode 30 and a second partitioned electrode 31 including sub-electrodes 32. A single cell is defined as including one of the sub-electrodes 32 and the portion of the grounded electrode 30 which is adjacent to the corresponding sub-electrode. FIG. 5A shows cells 1–n each including a sub-electrode 32 and an adjacent portion of electrode 30. FIG. 5B shows a single cell n, wherein the sub-electrode 32 is coupled to Vini from the signal generator 25 through a fixed impedance element Zfixed and an output signal Vout is detected from the sub-electrode 32. It should be apparent that the voltage detected from each cell is now dependent on the voltage divider network, the variable impedance provided from each cell and the fixed impedance element coupled to each sub-electrode 32. Hence, changes in conductance of each cell is now dependent on changes in conductance of Rs1. The remainder of the sensor functions in the same manner as with the embodiment shown in FIG. 4A. Specifically, the signal generator provides a signal to each cell and feedback circuit 27 compensates Vin for variations in conductance that are not due to the characteristic being measured.

The cells shown in FIGS. 5A and 5B may alternatively be coupled such that Vin is coupled to electrode 30 and each of sub-electrodes 32 are coupled to fixed impedance elements which, in turn, are coupled to ground.

Figure 6A:
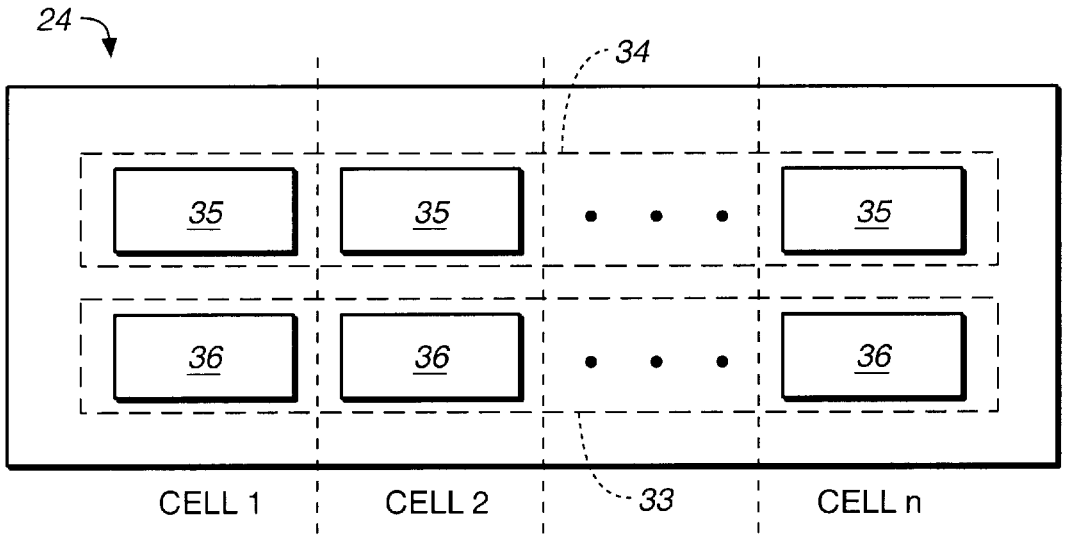
FIG. 6A shows a third embodiment of the cell array used in the $UW^3$ sensor.
Figure 6B:
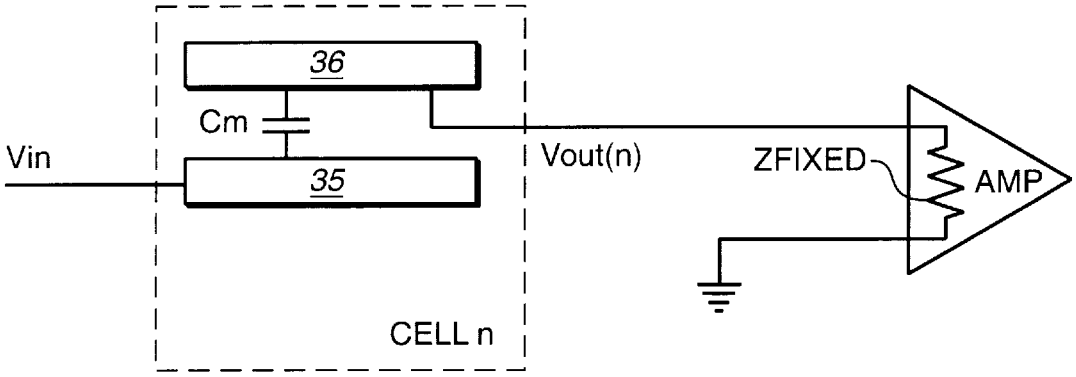
FIG. 6B shows the configuration of a single cell in the third embodiment of the cell array shown in FIG. 6A.

In still another embodiment of the cell array shown in FIGS. 6A and 6B, the cell array includes first and second elongated spaced apart partitioned electrodes 33 and 34, each including first and second sets of sub-electrodes 36 and 35, (respectively). A single cell (FIG. 6B) includes pairs of adjacent subelectrodes 35 and 36, wherein sub-electrode 35 in a given cell is independently coupled to the signal generator and sub-electrode 36 in the given cell provides Vout to a high impedance detector amplifier which provides Zfixed. This embodiment is useful when the material residing between the electrodes functions as a dielectric making the sensor impedance high. Changes in voltage Vout is then dependent on the dielectric constant of the material. This embodiment is conducive to being implemented at the dry end (FIG. 2A) of a sheetmaking system (and particularly beneath and in contact with continuous sheet 18) since dry paper has high resistance and its dielectric properties are easier to measure.

In a physical implementation of the sensor shown in FIG. 1A for performing individual measurements of more than one area of a material, one electrode of the sensor is grounded and the other electrode is segmented so as to form an array of electrodes (described in detail below). In this implementation, a distinct impedance element is coupled between Vin and each of the electrode segments. In an implementation for performing individual measurements of more than one area of a material of the sensor, the positions of the fixed impedance element and Zsensor are reversed from that shown in FIG. 1A. One electrode is coupled to Vin and the other electrode is segmented and coupled to a set of distinct fixed impedances which, in turn, are each coupled to ground. Hence, neither of the electrodes are grounded in this implementation of the sensor.

FIG. 3 illustrates a block diagram of one implementation of the sensor apparatus including cell array 24, signal generator 25, detector 26, and optional feedback circuit 27. Cell array 24 includes two elongated grounded electrodes 24A and 24B and center electrode 24C spaced apart and centered between electrodes 24A and 24B and made up of sub-electrodes 24D(1)–24D(n). A cell within array 24 is defined as including one of sub-electrodes 24D situated between a portion of each of the grounded electrodes 24A and 24B. For example, cell 2 includes sub-electrode 24D(2) and grounded electrode portions 24A(2) and 24B(2). For use in the system as shown in FIG. 2, cell array 24 resides beneath and in contact with supporting web 13 and can be positioned either parallel to the machine direction (MD) or to the cross direction (CD) depending on the type of information that is desired. In order to use the sensor apparatus to determine the weight of fiber in a wetstock mixture by measuring its conductivity, the wet stock must be in a state such that all or most of the water is held by the fiber. In this state, the water weight of the wet stock relates directly to the fiber weight and the conductivity of the water weight can be measured and used to determine the weight of the fiber in the wet stock.

Each cell is independently coupled to an input voltage (Vin) from signal generator 25 through an impedance element Zfixed and each provides an output voltage to voltage detector 26 on bus Vout. Signal generator 25 provides Vin. In one embodiment Vin is an analog waveform signal, however other signal types may be used such as a DC signal. In the embodiment in which signal generator 25 provides a waveform signal it may be implemented in a variety of ways and typically includes a crystal oscillator for generating a sine wave signal and a phase lock loop for signal stability. One advantage to using an AC signal as opposed to a DC signal is that it may be AC coupled to eliminate DC off-set.

Detector 26 includes circuitry for detecting variations in voltage from each of the sub-electrodes 24D and any conversion circuitry for converting the voltage variations into useful information relating to the physical characteristics of the aqueous mixture. Optional feedback circuit 27 includes a reference cell also having three electrodes similarly configured as a single cell within the sensor array. The reference cell functions to respond to unwanted physical characteristic changes in the aqueous mixture other than the physical characteristic of the aqueous mixture that is desired to be measured by the array. For instance, if the sensor is detecting voltage changes due to changes in water weight, the reference cell is configured so that it measures a constant water weight. Consequently, any voltage/conductivity changes exhibited by the reference cell are due to aqueous mixture physical characteristics other than weight changes (such as temperature and chemical composition). The feedback circuit uses the voltage changes generated by the reference cell to generate a feedback signal (Vfeedback) to compensate and adjust Vin for these unwanted aqueous mixture property changes (to be described in further detail below). The non-weight related aqueous mixture conductivity information provided by the reference cell may also provide useful data in the sheetmaking process.

Individual cells within sensor 24 can be readily employed in the system of FIGS. 2A and 2B so that each of the individual cells (1 to n) corresponds to each of the individual $UW^3$ sensors (or elements) 9A, 9B, and 9C. The length of each sub-electrode (24D (n)) determines the resolution of each cell. Typically, its length ranges from 1 in. to 6 in.

The sensor cells are positioned underneath the web, preferably upstream of the dry line, which on a fourdrinier, typically is a visible line of demarcation corresponding to the point where a glossy layer of water is no longer present on the top of the stock.

A method of constructing the array is to use a hydrofoil or foil from a hydrofoil assembly as a support for the components of the array. In a preferred embodiment, the grounded electrodes and center electrodes each has a surface that is flushed with the surface of the foil.

It should be understood that in the case in which an array 24 of sensor cells as shown in FIG. 3 cannot be placed along the machine or cross direction of the sheetmaking system due to obstructions within the system, then individual sensor cells are positioned along the cross or machine direction of the system. Each cell can then individually sense changes in conductivity at the point at which they are positioned which can then be used to determined basis weight. As shown in FIGS. 3 and 4*b* a single cell comprises at least one grounded electrode (either 24A(n) or 24B(n) or both) and a center electrode 24D(n).

The foregoing has described the principles, preferred embodiments and modes of operation of the present invention. However, the invention should not be construed as limited to the particular embodiments discussed. Instead, the above-described embodiments should be regarded as illustrative rather than restrictive, and it should be appreciated that variations may be made in those embodiments by workers skilled in the art without departing from the scope of present invention as defined by the following claims.

What is claimed is:

1. A system for controlling the cross-direction (CD) dry stock weight profile for a sheet of material that is being formed from wet stock on a de-watering machine that includes a water permeable moving wire supporting wet stock and a dry end, which system comprises:

(a) a headbox having a plurality of slices through which wet stock is introduced onto the moving wire;

(b) an array of water weight sensor elements (array) that is positioned underneath and adjacent to the wire wherein the array of water weight sensor elements is positioned to extend transversely of the wire and the array generates first signals indicative of a CD water weight profile from wet stock on the wire that is made up of a multiplicity of water weight measurements at different locations in the cross direction;

(c) a second sensor that measures the dry stock weight of the sheet of material at the dry end;

(d) means for predicting the CD dry stock weight profile for a segment of material that is on the wire by obtaining CD water weight profile of the segment and for generating second signals that are indicative of the predicted CD dry stock weight; and (e) means for controlling the CD dry stock weight profile based on said second signals.

2. The system as defined in claim 1 wherein the second sensor is a scanning sensor that generates signals indicative of a CD profile comprising a multiplicity of the dry stock weight measurements in the cross direction.

3. The system as defined in claim 1 comprising a plurality of actuators that control the plurality of slices and wherein the system includes means for activating the plurality of actuators in response to said signals.

4. The system as defined in claim 1 wherein the de-watering machine comprises vacuum means to remove water from the wet stock from the wire and wherein the system includes means for regulating vacuum means in response to said second signals.

5. The system as defined in claim 1 wherein the de-watering machine comprises dryer means to remove water from partially de-watered sheet material exiting the wire and wherein the system includes means for regulating dryer means in response to said second signals.

6. The system as defined in claim 1 wherein said array comprises a sensor unit including a first electrode and a second electrode which is spaced-apart and adjacent to said first electrode, said wet stock being between and in close proximity to said first and said second electrodes, said sensor unit coupled in series with said impedance element between an input signal and a reference potential; and wherein fluctuations in at least one property of said wet stock causes changes in voltage measured across said sensor.

7. The system as defined in claim 6 wherein said first electrode is coupled to said impedance element and said second electrode is coupled to said reference potential.

8. The system as defined in claim 7 wherein said first electrode is coupled to said input signal and said second electrode is coupled to said impedance element.

9. The system as defined in claim 7 wherein said impedance element comprises a plurality of resistive elements and said first electrode comprises a plurality of electrically isolated sub-electrodes which are each coupled to one of said plurality of resistive elements.

10. The system as defined in claim 8 wherein said second electrode comprises a set of electrically isolated sub-electrodes and said impedance element comprises a plurality of resistive elements, wherein said first electrode is coupled to said input signal and each of said set of sub-electrodes is coupled to one of said plurality of resistive elements.

11. The system as defined in claim 7 further including a third electrode coupled to said reference potential, said first electrode being spaced-apart and residing between said second and said third electrodes, wherein another portion of said sheet of material is between and in close proximity to said first and said third electrodes.

12. The system as defined in claim 6 further comprising means for providing a feedback signal to adjust said input signal such that said fluctuations in at least one property are due to fluctuations in a single physical characteristic of said wet stock.

13. The system as defined in claim 12 wherein said physical properties include dielectric constant, conductivity, and proximity of said portion of said wet stock to said sensor and said single physical characteristic of said wet stock comprises one of weight, chemical composition, and temperature.

14. The system as defined in claim 6 wherein said impedance element is one of an inductive element and capacitive element each having an associated impedance and said input signal has an associated frequency and wherein said associated impedance of said one of said inductive and capacitive element may be set to a particular magnitude by adjusting said associated frequency to a given magnitude.

15. The system as defined in claim 14 wherein said sensor unit has an associated impedance and said associated frequency is adjusted such that said sensor impedance and said impedance of said one of said capacitive element and said inductive element are approximately equal.

16. A method of controlling the cross-direction (CD) dry stock weight of a sheet of material that is formed from wet stock in a process that employs a de-watering machine that includes a headbox comprising a plurality of slices through which wet stock is introduced onto a water permeable moving wire and a dry end which comprises the steps of:

(a) positioning an array of water weight sensor elements (array) underneath and adjacent to the wire wherein the array is positioned perpendicular to the moving wire;

(b) operating the machine and measuring the water weights of the sheet of material with the array to generate a CD water weight profile;

(c) positioning a second sensor at the dry end to measure the CD dry stock weight of the sheet of material that is formed;

(d) predicting the CD dry stock weight profile for a sheet of material that is on the wire based on the CD water weight profile for the sheet of material; and (e) controlling the CD dry stock weight profile.

17. The method as defined in claim 16 wherein the second sensor is a scanning sensor.

18. The method as defined in claim 16 further comprising the step h) of applying readings from the array in a feedback mechanism to control at least one process parameter to regulate the water weight of the wet stock in the cross direction on the wire.

19. The method as defined in claim 18 wherein the de-watering machine comprises a headbox having actuators that control the discharge of wet stock through a plurality of slices and wherein the feedback mechanism controls the discharge of wet stock through the slices.

20. The method as defined in claim 16 wherein said array includes a sensor unit including a first electrode and a second electrode which is spaced-apart and adjacent to said first electrode, said wet stock being between and in close proximity to said first and said second electrodes, said sensor coupled in series with said impedance element between an input signal and a reference potential and wherein fluctuations in at least one of said properties of said wet stock causes changes in voltage measured across said sensor.

21. The method as defined in claim 20 wherein said first electrode is coupled to said impedance element and said second electrode is coupled to said reference potential.

22. The method as defined in claim 16 wherein step (e) comprises double digital filtering the water weight measurements.

* * * * *